US011970869B2

(12) United States Patent
Wu et al.

(10) Patent No.: US 11,970,869 B2
(45) Date of Patent: Apr. 30, 2024

(54) PUMP TRUCK BOOM CONTROL METHOD, PUMP TRUCK BOOM CONTROL SYSTEM AND PUMP TRUCK

(71) Applicant: ZOOMLION HEAVY INDUSTRY SCIENCE AND TECHNOLOGY CO., LTD., Changsha (CN)

(72) Inventors: Liang Wu, Changsha (CN); Jun Yin, Changsha (CN); Ze Chen, Changsha (CN); Liang Wan, Changsha (CN); Xinyu Fu, Changsha (CN)

(73) Assignee: ZOOMLION HEAVY INDUSTRY SCIENCE AND TECHNOLOGY CO., LTD., Changsha (CN)

( * ) Notice: Subject to any disclaimer, the term of this patent is extended or adjusted under 35 U.S.C. 154(b) by 533 days.

(21) Appl. No.: 17/252,486

(22) PCT Filed: Jul. 11, 2019

(86) PCT No.: PCT/CN2019/095546
§ 371 (c)(1),
(2) Date: Dec. 15, 2020

(87) PCT Pub. No.: WO2020/258381
PCT Pub. Date: Dec. 30, 2020

(65) Prior Publication Data

US 2021/0293038 A1 Sep. 23, 2021

(30) Foreign Application Priority Data

Jun. 25, 2019 (CN) ..... 201910555519.9

(51) Int. Cl.
*E04G 21/00* (2006.01)
*E04G 21/04* (2006.01)

(52) U.S. Cl.
CPC ..... *E04G 21/0463* (2013.01); *E04G 21/0436* (2013.01)

(58) Field of Classification Search
CPC ..... E04G 21/0436; E04G 1/0463; E04G 21/0445; E04G 21/00
(Continued)

(56) References Cited

U.S. PATENT DOCUMENTS 6,098,322 A * 8/2000 Tozawa ..... E02F 3/437 701/50
6,246,939 B1 * 6/2001 Nozawa ..... E02F 3/432 172/810
(Continued)

FOREIGN PATENT DOCUMENTS

CN 103031958 A 4/2013
CN 103558875 A 2/2014
(Continued)

*Primary Examiner* — Jonathan L Sample
(74) *Attorney, Agent, or Firm* — Volpe Koenig

(57) ABSTRACT

The invention relates to the technical field of pump truck control, and discloses a pump truck boom control method, a pump truck boom control system and a pump truck. The pump truck boom control method comprises: detecting a working condition of a boom, wherein the boom is divided into first-type arms close to the first arm and second-type arms close to the last arm in advance; and controlling each arm in the first-type arms to act at respective preset movement speed when the boom is in an opening placing boom working condition before the construction or in a folding placing boom working condition after the construction. The method can realize speed-up control on movement speeds of the each arm in the first-type arms under the opening placing boom working condition before the construction or under the folding placing boom working condition after the construction without a boom posture detection sensors.

9 Claims, 6 Drawing Sheets

(58) Field of Classification Search
USPC ..... 701/50
See application file for complete search history.

(56) References Cited

U.S. PATENT DOCUMENTS

| | | | | |
|---|---|---|---|---|
| 6,375,432 | B1 * | 4/2002 | Krasny | F04B 49/00 417/403 |
| 10,787,790 | B2 * | 9/2020 | Imura | E02F 9/22 |
| 2008/0162005 | A1 * | 7/2008 | Tang | E04G 21/04 701/50 |
| 2014/0298784 | A1 * | 10/2014 | Huang | B66C 13/066 60/327 |
| 2014/0325976 | A1 * | 11/2014 | Schabelreiter | F15B 15/061 248/558 |
| 2016/0298660 | A1 * | 10/2016 | Wang | F15B 21/008 |
| 2016/0298719 | A1 * | 10/2016 | Wang | F15B 21/008 |
| 2020/0407951 | A1 * | 12/2020 | Daimon | E02F 9/262 |
| 2021/0062460 | A1 * | 3/2021 | Chiba | E02F 3/435 |

FOREIGN PATENT DOCUMENTS

| | | | | |
|---|---|---|---|---|
| CN | 104453238 | A | 3/2015 | |
| CN | 105460809 | A | 4/2016 | |
| CN | 108340373 | A | 7/2018 | |
| DE | 10 2009 007 310 | A1 | 8/2010 | |
| EP | 1847667 | A2 * | 10/2007 | E04G 21/04 |
| WO | 2014166637 | A1 | 10/2014 | |

* cited by examiner

PUMP TRUCK BOOM CONTROL METHOD, PUMP TRUCK BOOM CONTROL SYSTEM AND PUMP TRUCK

CROSS REFERENCE TO RELATED APPLICATIONS

This application is a 35 USC § 371 national stage of international application No. PCT/CN2019/095546, which is entitled "PUMP TRUCK BOOM CONTROL METHOD, PUMP TRUCK BOOM CONTROL SYSTEM AND PUMP TRUCK," was filed Jul. 11, 2019, and claims priority to Chinese Application No. 201910555519.9, filed on Jun. 25, 2019, both of which are incorporated herein by reference as if fully set forth.

FIELD OF THE INVENTION

The present invention relates to the technical field of pump truck control, in particular to a pump truck boom control method, a pump truck boom control system and a pump truck.

BACKGROUND OF THE INVENTION

During building construction, a concrete pump truck becomes more and more important pumping construction equipment due to its high flexibility. However, in the process of pump truck transferring, a boom needs to be folded fully first, and then needs to be unfolded fully after the pump truck reaches a new construction position. It takes a lot of time for opening placing boom and folding placing boom, especially at present, the length of the boom is getting longer and longer, and the number of arms is increasing. Strict safety standard limits the maximum movement speed of the boom end, so that it is very important to maximize the boom movement speed within the limited range for improving the construction efficiency.

In the existing technology, the following two technical solutions are mainly used to improve the boom movement speed: (1) a pump truck boom control system adjusts and limits the speed of each arm according to the boom end movement speed when leaving the factory. When the movement speed of the end of the boom is calculated, it is assumed that a boom posture is in a limit working condition, that is, all arms are in a straight line. By limiting the maximum current of a multi-way valve corresponding to each arm, an opening degree of the multi-way valve can be limited, so as to limit the movement speed of each arm; and (2) a large number of sensors are installed on the boom of the pump truck, and the boom posture is obtained directly or indirectly through a detection signal, and the movement speed of the end of the boom is calculated according to a real-time posture of the boom, and the opening degree of the multi-way valve of the boom is given in real time to realize the maximum control on the boom movement speed.

The above technical solution (1) is to control the movement speed of the end of the boom according to the limit working conditions of the boom, which does not conform to the actual boom posture, and the movement speed of the boom is slow. The above technical solution (2) has the following disadvantages: a large number of sensors are installed at the boom, so that the cost is high, and the pumping construction working condition is bad, so that the sensors are easy to damage, resulting in control failure; and the boom posture is changeable, and the boom speed is controlled in real time according to the boom posture, resulting in complex control algorithm, frequent speed adjustment and poor operation experience.

SUMMARY OF THE INVENTION

The purpose of the present invention is to provide a pump truck boom control method, a pump truck boom control system and a pump truck, to realize the speed-up control on the movement speed of each arm in first-type arms under an opening placing boom working condition before the construction or a folding placing boom working condition after the construction without boom posture detection sensors.

In order to achieve the above purpose, the present invention provides a pump truck boom control method, comprising: detecting a working condition of a boom, wherein the boom is divided into first-type arms close to the first arm and second-type arms close to the last arm in advance; and controlling each arm in the first-type arms to act at respective preset movement speed under the condition that the boom is in an opening placing boom working condition before the construction or a folding placing boom working condition after the construction.

Optionally, wherein the respective preset movement speed is corresponding movement speed of the each arm under the condition that a boom end speed when the second-type arms are fully folded and the first-type arms are fully unfolded is within a movement speed threshold range.

Optionally, wherein the step of detecting a working condition of a boom comprises: collecting a pumping state signal, the first arm on site state signal and a timing signal for action enabling signals corresponding to the each arm in the second-type arms; and determining the working condition of the boom, according to the pumping state signal, the first arm on site state signal and the timing signal for the action enabling signals corresponding to the each arm in the second-type arms.

Optionally, wherein the step of determining the working condition of the boom, according to the pumping state signal, the first arm on site state signal and the timing signal for the action enabling signals corresponding to the each arm in the second-type arms comprises: determining that the boom is in the opening placing boom working condition before the construction, when the pumping state signal indicates that the pump truck is not in a pumping state, the first arm on site signal indicates that the boom changes from a fully folded state to a non-fully folded state, and accumulated unfolding time, determined by the timing signal, of the second-type arms is smaller than first preset time; or determining that the boom is in the folding placing boom working condition after the construction, when the pumping state signal indicates that the pump truck is in a reverse pumping state, and the number of reverse pumping times is greater than a preset number of times, and accumulated folding time, determined by the timing signal, of the second-type arms is greater than second preset time, wherein, the first preset time is a product of the time taken by the second-type arms to be fully unfolded and a first preset coefficient, the second preset time is a product of the time taken by the second-type arms to be fully folded and a second preset coefficient, and both the first preset coefficient and the second preset coefficient are smaller than 1.

Optionally, wherein the step of determining the working condition of the boom, according to the pumping state signal, the first arm on site state signal and the timing signal for the action enabling signals corresponding to the each arm in the second-type arms comprises: determining that the boom is in the opening placing boom working condition before the construction, when the pumping state signal indicates that the pump truck is not in the pumping state, the first arm on site signal indicates that the boom changes from the fully folded state to the non-fully folded state, and unfolding time, determined by the timing signal, of any one arm in the second-type arms is smaller than corresponding third preset time; or determining that the boom is in the folding placing boom working condition after the construction when the pumping state signal indicates that the pump truck is in the reverse pumping state, and the number of reverse pumping times is greater than the preset number of times, and folding time, determined by the timing signal, of any one arm in the second-type arms is greater than corresponding fourth preset time, wherein, the corresponding third preset time is a product of the time taken by each arm in the second-type arms to be fully unfolded and a third preset coefficient, the corresponding fourth preset time is a product of the time taken by each arm in the second-type arms to be fully folded and a fourth preset coefficient, and both the third preset coefficient and the fourth preset coefficient are smaller than 1.

Accordingly, the present invention also provides a pump truck boom control system, comprising: a detection device, for detecting a working condition of a boom, wherein the boom is divided into first-type arms close to the first arm and second-type arms close to the last arm in advance; and a control device, for controlling each arm in the first-type arms to act at respective preset movement speed under the condition that the boom is in an opening placing boom working condition before the construction or a folding placing boom working condition after the construction.

Optionally, wherein the respective preset movement speed is corresponding movement speed of the each arm under the condition that a boom end speed when the second-type arms are fully folded and the first-type arms are fully unfolded is within a movement speed threshold range.

Optionally, wherein the detection device comprises: a collecting unit, for collecting a pumping state signal, the first arm on site state signal and a timing signal for action enabling signals corresponding to the each arm in the second-type arms; and a determining unit, for determining the working condition of the boom, according to the pumping state signal, the first arm on site state signal and the timing signal for the action enabling signals corresponding to the each arm in the second-type arms.

Optionally, wherein a process of determining, by the determining unit, the working condition of the boom, according to the pumping state signal, the first arm on site state signal and the timing signal for the action enabling signals corresponding to the each arm in the second-type arms comprises: determining that the boom is in the opening placing boom working condition before the construction, when the pumping state signal indicates that the pump truck is not in a pumping state, the first arm on site signal indicates that the boom changes from a fully folded state to a non-fully folded state, and accumulated unfolding time, determined by the timing signal, of the second-type arms is smaller than first preset time; or determining that the boom is in the folding placing boom working condition after the construction, when the pumping state signal indicates that the pump truck is in a reverse pumping state, the number of reverse pumping times is greater than a preset number of times, and accumulated folding time, determined by the timing signal, of the second-type arms is greater than second preset time, wherein, the first preset time is a product of the time taken by the second-type arms to be fully unfolded and a first preset coefficient, the second preset time is a product of the time taken by the second-type arms to be fully folded and a second preset coefficient, and both the first preset coefficient and the second preset coefficient are smaller than 1.

Optionally, wherein a process of determining, by the determining unit, the working condition of the boom, according to the pumping state signal, the first arm on site state signal and the timing signal for the action enabling signals corresponding to the each arm in the second-type arms comprises: determining that the boom is in the opening placing boom working condition before the construction, when the pumping state signal indicates that the pump truck is not in the pumping state, the first arm on site signal indicates that the boom changes from the fully folded state to the non-fully folded state, and unfolding time, determined by the timing signal, of any one arm in the second-type arms is smaller than corresponding third preset time; or determining that the boom is in the folding placing boom working condition after the construction, when the pumping state signal indicates that the pump truck is in the reverse pumping state, and the number of reverse pumping times is greater than the preset number of times, and folding time, determined by the timing signal, of any one arm in the second-type arms is greater than corresponding fourth preset time, wherein, the corresponding third preset time is a product of the time taken by each arm in the second-type arms to be fully unfolded and a third preset coefficient, the corresponding fourth preset time is a product of the time taken by each arm in the second-type arms to be full folded and a fourth preset coefficient, and both the third preset coefficient and the fourth preset coefficient are smaller than 1.

Accordingly, the present invention also provides a pump truck, wherein the pump truck is equipped with the above pump truck boom control system.

Accordingly, the present invention also provides a machine-readable storage medium, wherein the machine-readable storage medium stores instructions that are used for enabling a machine to execute the above-mentioned pump truck boom control method.

According to the above technical solution, the present invention creatively detects the working condition of the boom, and controls the each arm in the first-type arms to act at respective preset movement speed under the condition that the boom is in the opening placing boom working condition before the construction or the folding placing boom working condition after the construction, so as to realize the speed-up control on the movement speeds of the each arm in the first-type arms under the opening placing boomworking condition before the construction or the folding placing boom working condition after the construction without boom posture detection sensors.

Other features and advantages of the present invention will be described in detail in the subsequent part of Detailed Description of the Embodiments.

BRIEF DESCRIPTION OF DRAWINGS

The accompanying drawings are provided for further understanding of the present invention, and constitute one part of the description. They serve to explain the present invention in conjunction with the following specific embodiments, rather than to limit the present invention. In the accompanying drawings.

DESCRIPTION FOR SYMBOLS IN THE ACCOMPANYING DRAWINGS

10 detection device 20 control device

DETAILED DESCRIPTION OF THE EMBODIMENTS

The specific embodiments of the present invention will be described in detail below in conjunction with the accompanying drawings. It should be understood that the specific embodiments described herein are merely intended to describe and explain the present invention, rather than to limit the present invention.

A pump truck boom control system of the present invention does not need to be internally provided with boom posture detection sensors, so it is impossible to perform refining control on the movement speed of each arm by accurately calculating an movement speed of the end of the boom, and thus it is necessary to carry out classified fuzzy control on the boom. In order to make the control simple and practical, according to the overall movement speed of the boom, the whole boom can be divided into two categories: first-type arms close to the first arm, which has a relatively slow angular speed; and second-type arms close to the last arm, which has a relatively fast angular speed. For example, in a pump truck with six arms, the first to third arms are the first-type arms, and the fourth to sixth arms are the second-type arms.

In the actual construction of a pump truck (such as a concrete pump truck), the movement speed in a pumping and distribution construction process is relatively slow, and the maximum speed of the boom is not pursued. Therefore, the present invention does not control the process. However, an opening placing boom working condition before the construction and a folding placing boom working condition after the construction require the pump truck to be in place or leave as soon as possible, and the boom is generally required to rapidly act. Therefore, the present invention only performs speed-up control on the movement speed of the two working conditions. Specifically, the basic control principle of the present invention is as follows: according to a basic control signal in an existing electric control system, the working condition of the boom is detected in real time. When the boom is in the above two boom working conditions, and under the premise of ensuring that the speed of a boom end is the maximum speed (generally linear speed) set according to the safety standard, only the first-type arms with slow movement speed are subjected to boom speed-up control, so that the movement speed of the boom can be improved on the whole.

Figure 1:
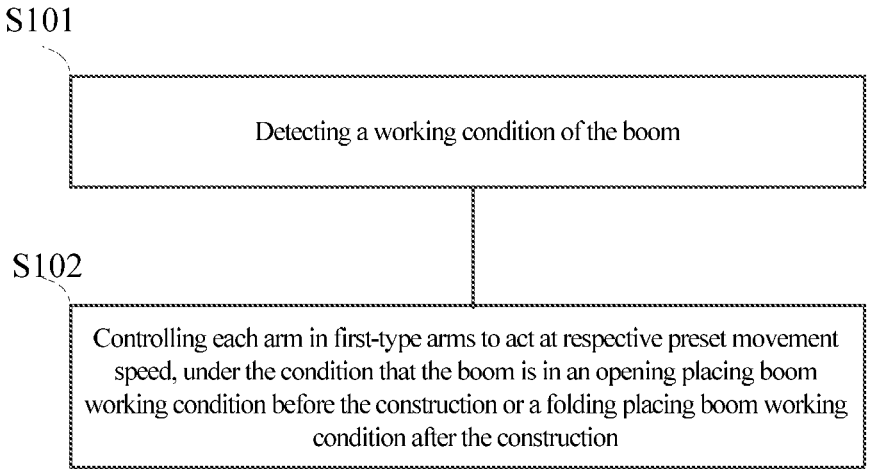
FIG. 1 is a flowchart of a pump truck boom control method provided by an embodiment of the present invention.

FIG. 1 is a flowchart of a method for controlling a movement speed of a boom of a pump truck provided by an embodiment of the present invention. As shown in FIG. 1, the method for controlling the movement speed of the boom of the pump truck can comprise the following steps: step S101, detecting a working condition of the boom, and step S102, controlling each arm in first-type arms to act at respective preset movement speed, under the condition that the boom is in an opening placing boom working condition before the construction or a folding placing boom working condition after the construction. The respective preset movement speed is corresponding movement speed of the each arm under the condition that the movement speed of the boom end when the second-type arms are fully folded and the first-type arms are fully unfolded is within a movement speed threshold range.

Wherein, a maximum value of the movement speed threshold range can be a maximum speed set according to the safety standard, and a minimum value of the movement speed threshold range can be a movement speed smaller than the maximum speed by a preset value. The preset value can be reasonably set based on the actual situation, and is usually small.

The step of detecting the working condition of the boom can comprises: collecting a pumping state signal, the first arm (i.e. the $1^{st}$ arm) on site state signal and a timing signal for action enabling signals corresponding to each arm in the second-type arms; and determining a working condition of the boom according to the pumping state signal, the first arm on site state signal and the timing signal for the action enabling signals corresponding to the each arm in the second-type arms. According to the working condition of the boom, the first-type arms are controlled to act at respective conventional movement speeds or higher preset movement speeds.

Figure 2:
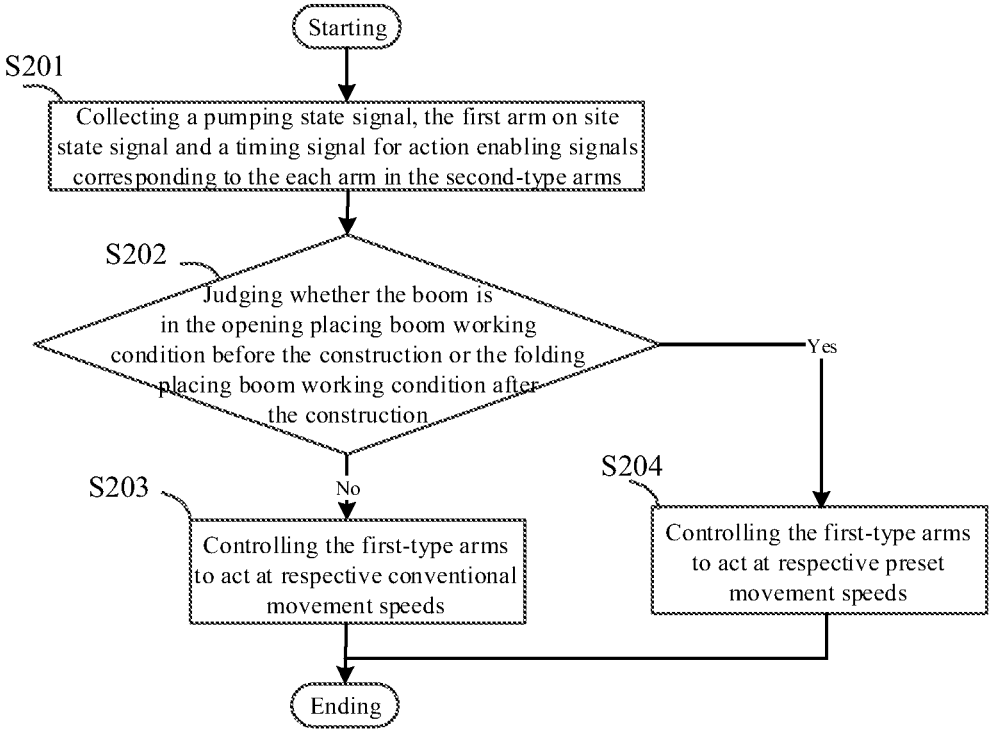
FIG. 2 is a flowchart of a pump truck boom control method provided by an embodiment of the present invention.

Specifically, as shown in FIG. 2, a pump truck boom control method provided by the present invention can comprise the following steps.

Step S201, collecting a pumping state signal, the first arm on site state signal and a timing signal for action enabling signals corresponding to the each arm in the second-type arms.

Step S202, judging whether the boom is in the opening placing boom working condition before the construction or the folding placing boom working condition after the construction, and if the boom is in one of the above two working conditions, executing a step S204, otherwise, performing a step S203.

Step S203, controlling the first-type arms to act at respective conventional movement speeds.

Step S204, controlling the first-type arms to act at respective preset movement speeds.

For example, the respective preset movement speed can be corresponding movement speed of the each arm under the condition that an speed of the boom end when the second-type arms are fully folded and the first-type arms are fully unfolded is a maximum movement speed set according to the safety standard. The respective preset movement speeds are greater than the conventional movement speed.

The step of determining the working condition of the boom according to the pumping state signal, the first arm on site state signal and the timing signal for the action enabling signals corresponding to the each arm in the second-type arms can comprise: determining that the boom is in the opening placing boom working condition before the construction, when the pumping state signal indicates that the pump truck is not in a pumping state, the first arm on site state signal indicates that the boom changes from a fully folded state to a non-fully folded state, and accumulated unfoliding time, determined by the timing signal, of the second-type arms is smaller than first preset time; or determining that the boom is in the folding placing boom working condition after the construction, when the pumping state signal indicates that the pump truck is in a reverse pumping state and the number of reverse pumping times is greater than a preset number of times and accumulated folding time, determined by the timing signal, of the second-type arms is greater than second preset time. Wherein, the first preset time is the product of the time taken by the second-type arms to be fully unfolded and a first preset coefficient; the second preset time is the product of the time taken by the second-type arms to be fully folded and a second preset coefficient, and both the first preset coefficient and the second preset coefficient are smaller than 1.

Figure 3:
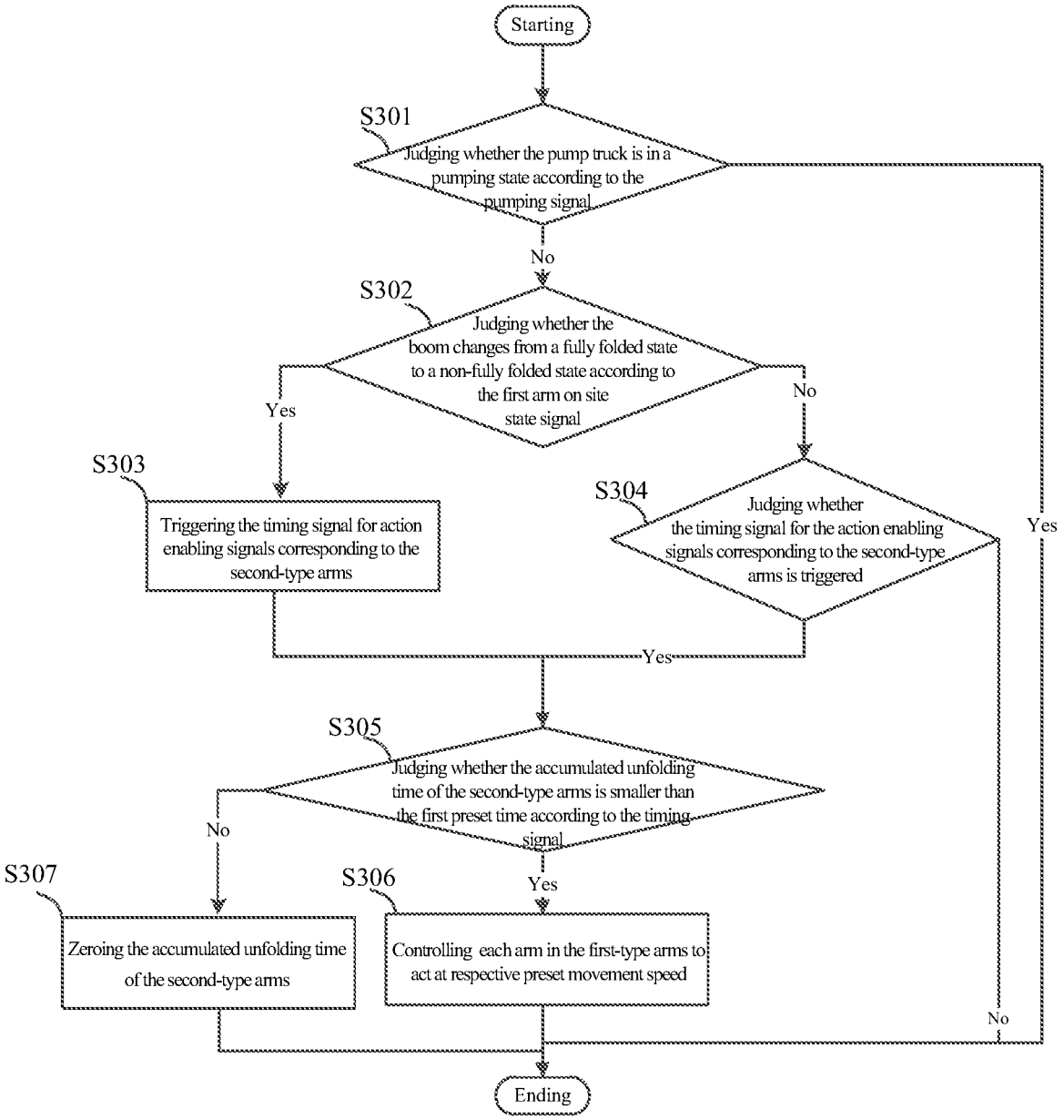
FIG. 3 is a flowchart of a process of detecting an opening placing boom working condition before the construction and a process of controlling the movement of first-type arms provided by an embodiment of the present invention.

Specifically, as shown in FIG. 3, a process of detecting that the working condition of the pump truck is the opening placing boom working condition before construction and controlling the first-type arms to act provided by the present invention can comprise the following steps.

Step S301, judging whether the pump truck is in a pumping state according to the pumping signal, and ending the process when the pump truck is in the pumping state; otherwise, executing a step S302.

When the pump truck is not in the pumping state, it is indicated that the pump truck is not in a construction working condition. Once it is detected that the pump truck is in the pumping state, it is indicated that the pump truck is in the construction state, and the process is ended.

Step S302, judging whether the boom changes from the fully folded state to the non-fully folded state, according to the first arm on site state signal; and if so, executing a step S303, otherwise, executing a step S304.

Step S303, triggering a timing signal for action enabling signals corresponding to the second-type arms.

Step S304, judging whether the timing signal for the action enabling signals corresponding to the second-type arms is triggered; and if so, executing a step S305, otherwise, ending the process.

After the boom changes from the fully folded state to the non-fully folded state, and when the timing signal for the action enabling signals corresponding to the second-type arms is triggered, it is determined that the second-type arms start to perform the opening placing boom action.

Step S305, judging whether the accumulated unfolding time of the second-type arms is smaller than the first preset time according to the timing signal; and if so, executing a step S306, otherwise, executing a step S307.

When the timing signal for the action enabling signals corresponding to the second-type arms is triggered, start timing the unfolding process of the second-type arms, and when the accumulated unfolding time of the second-type arms is smaller than the first preset time, it is indicated that the second-type arms are not fully unfolded, at this time, it is determined that the boom is in the boom unfolding working condition before construction.

Step S306, controlling each arm in the first-type arms to act at respective preset movement speed.

When the accumulated unfolding time of the second-type arms is smaller than the first preset time, it is indicated that the second-type arms are not fully unfolded, and at this time, the unfolding speed of the first-type arms is controlled to be sped up.

Taking the first-type arms (the $1^{st}$ to $3^{rd}$ arms) in a pump truck with six arms as an example, the preset angular speeds corresponding to the first-type arms, i.e., the $1^{st}$ to $3^{rd}$ arms, calculated based on the maximum speed (set according to the safety standard) of the boom end when the second-type arms are fully folded and the first-type arms are fully unfolded are w1, w2 and w3 respectively (w1<w2<w3), and then the first-type arms, i.e., the $1^{st}$ to $3^{rd}$ arms act according to the preset angular speeds w1, w2 and w3 respectively.

Step S307, zeroing the accumulated unfolding time of the second-type arms.

When the accumulated unfolding time of the second-type arms is greater than or equal to the first preset time, it is indicated that the second-type arms have been basically fully unfolded. At this time, the length of the boom is relatively long. If the each arm in the first-type arms are still controlled to act at higher preset movement speeds, it is very likely that the movement speed of the boom end will exceed the maximum speed set according to the safety standard, and then great potential safety hazard will be brought to the pump truck and the construction site. Thus, the accumulated unfolding time of the second-type arms needs to be zeroed.

The control system adopted in the embodiment of the present invention detects the working condition of the boom in real time according to the basic control signals in the existing electric control system, so that it is not necessary to install various boom posture detection sensors, and thus the cost of a collecting device is reduced and the failure possibility is reduced. By only focusing on the key boom working conditions (such as the opening placing boom working condition before the construction or the folding placing boom working condition after the construction, and performing classified control on the boom, the control logic is simplified on the whole, and the practicability is stronger.

Figure 4:
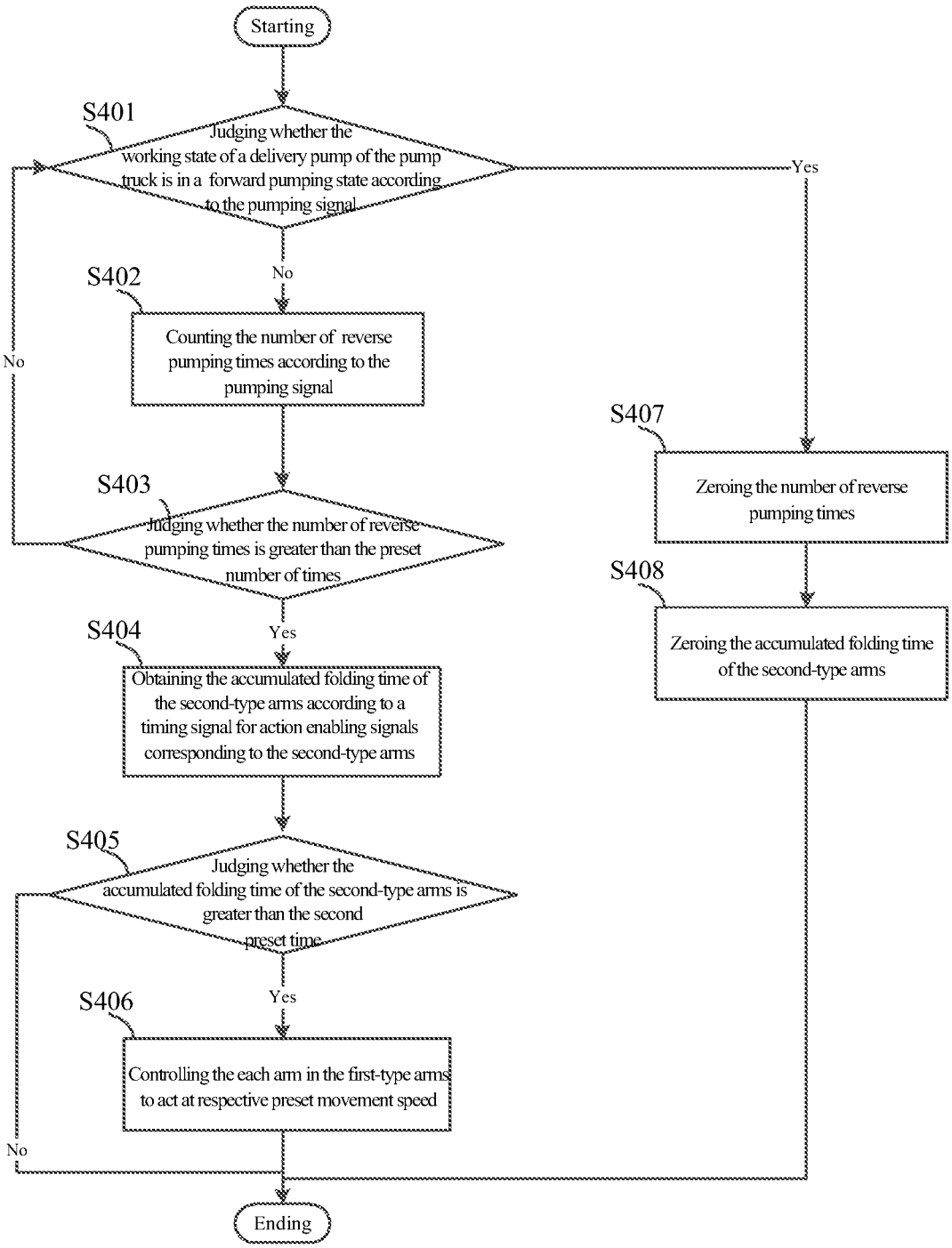
FIG. 4 is a flowchart of a process of detecting a folding placing boomworking condition after the construction and a process of controlling the movement of first-type arms provided by an embodiment of the present invention.

Specifically, as shown in FIG. 4, a process of detecting that the working condition of the pump truck is the folding placing boom working condition after construction and controlling the first-type arms to act provided by the present invention can comprise the following steps.

Step S401, judging whether a working state of a delivery pump of the pump truck is a forward pumping state according to the pumping signal; and if so, executing a step S407, otherwise, executing a step S402.

When the working state of the delivery pump is not in the forward pumping state, it is indicated that the pump truck is not in a construction working condition.

Step S402, counting the number of reverse pumping times according to the pumping signal.

Step S403, judging whether the number of reverse pumping times is greater than the preset number of times; and if so, executing a step S404, otherwise, executing the step S401.

When the number of reverse pumping times is greater than the preset number of times, it is indicated that the delivery pump completely sucks the material (such as concrete) from a delivery pipe and pushes the material into a hopper.

Step S404, obtaining the accumulated folding time of the second-type arms according to the timing signal for action enabling signals corresponding to the second-type arms.

In the case where the timing signal is triggered, start timing the folding process of the second-type arms.

Step S405, judging whether the accumulated folding time of the second-type arms is greater than the second preset time; and if so, executing a step S406, otherwise, ending the process.

When the accumulated folding time of the second-type arms is greater than the second preset time, it is indicated that the folding action of the second-type arms is basically completed, that is to say, it is determined that the boom is in the boom folding working condition after construction, and at this time, the folding speed of the first-type arms can be controlled to be sped up.

If the accumulated folding time of the second-type arms is smaller than or equal to the second preset time, it is indicated that it takes some time for the folding action of the second-type arms to be completed. At this time, the length of the boom is relatively long. If the each arm in the first-type arms are still controlled to act at higher preset speeds, it is very likely that the movement speed of the boom end will exceed the maximum speed set according to the safety standard, and further, great safety hazard will be brought to the pump truck and the construction site. Thus, the process is ended.

Step S406, controlling the each arm in the first-type arms to act at respective preset movement speed.

Taking the first-type arms (the $1^{st}$ to $3^{rd}$ arms) in a pump truck with six arms as an example, the preset angular speeds corresponding to the first-type arms, i.e., the $1^{st}$ to $3^{rd}$ arms calculated based on the maximum speed (set according to the safety standard) of the boom end when the second-type arms are fully folded and the first-type arms are fully unfolded are w1, w2 and w3 respectively (w1<w2<w3), then the first-type arms, i.e., the $1^{st}$ to $3^{rd}$ armsact according to the preset angular speeds w1, w2 and w3 respectively.

Step S407, zeroing the number of reverse pumping times.

Once the delivery pump is in the forward pumping state, it is indicated that the pump truck is in the construction state, and the previously counted number of reverse pumping times needs to be zeroed.

Step S408, zeroing the accumulated folding time of the second-type arms.

Once the delivery pump is in the forward pumping state, it is indicated that the pump truck is in the construction state, and the previous accumulated folding time of the second-type arms needs to be zeroed.

In the above embodiment, whether the second-type arms complete the unfolding action is judged according to the accumulated unfolding time of the second-type arms. In order to avoid the case that the unfolding time of one arm is too long and the unfolding time of another arm is too short in the unfolding process of the second-type arms, since the arms in the second-type arms have corresponding preset unfolding time, in a preferred embodiment, the step of determining the working condition of the boom according to the pumping state signal, the first arm on site state signal and the timing signal for the action enabling signals corresponding to each arm in the second-type arms can comprise: determining that the boom is in the opening placing boom working condition before the construction when the pumping state signal indicates that the pump truck is not in the pumping state, and the first arm on site state signal indicates that the boom changes from the fully folded state to the non-fully folded state and the unfolding time, determined by the timing signal, of any one arm in the second-type arms is smaller than corresponding third preset time; or determining that the boom is in the folding placing boom working condition after the construction when the pumping state signal indicates that the pump truck is in the reverse pumping state and the number of reverse pumping times is greater than the preset number of times, and the folding time, determined by the timing signal, of any one arm in the second-type arms is greater than corresponding fourth preset time.

Wherein, the corresponding third preset time is the product of the time taken by the each arm in the second-type arms to be fully unfolded and a third preset coefficient; and the corresponding fourth preset time is the product of the time taken by the each arm in the second-type arms to be fully folded and a fourth preset coefficient, and both the third preset coefficient and the fourth preset coefficient are smaller than 1.

Figure 5:
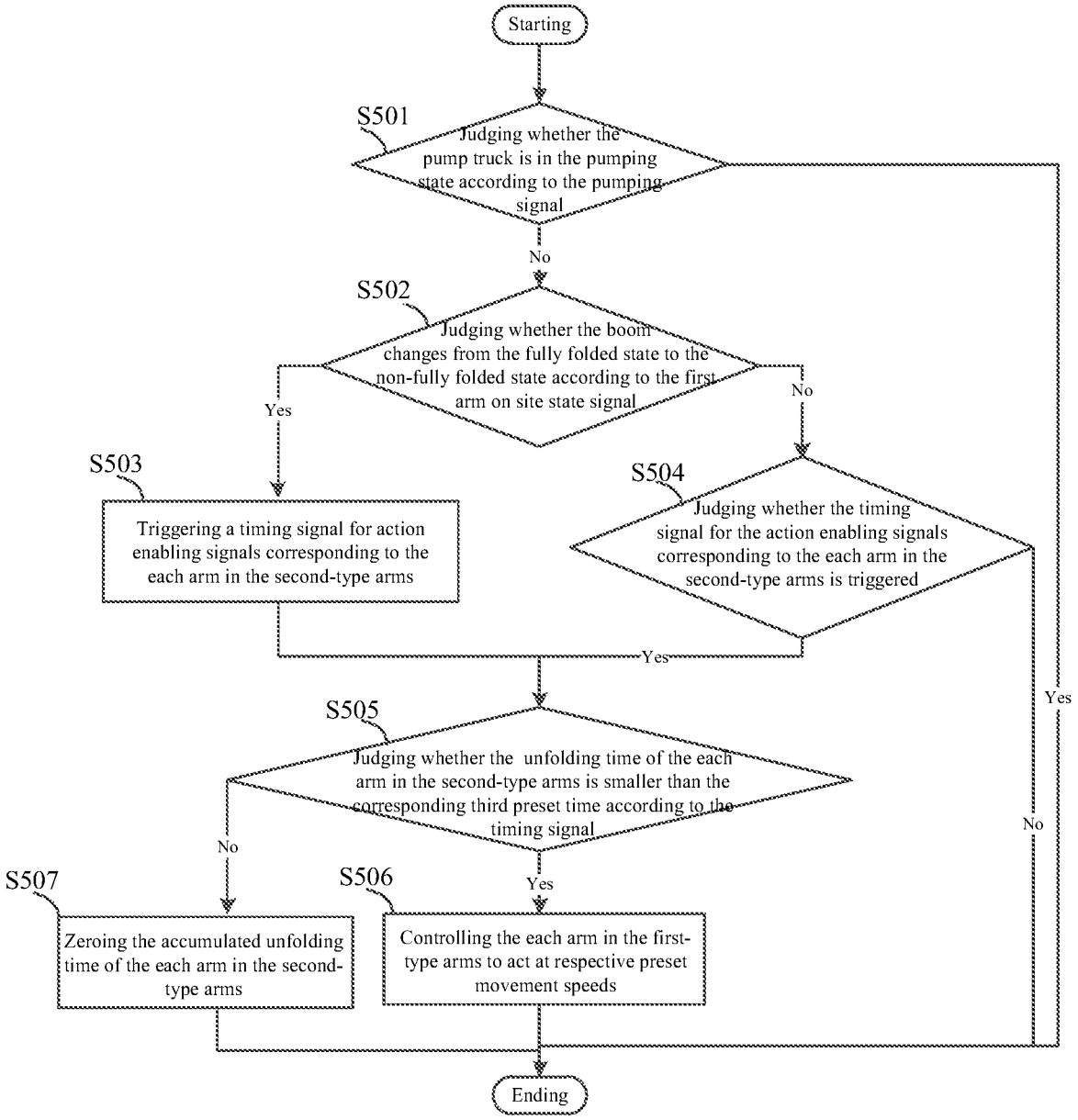
FIG. 5 is a flowchart of a process of detecting an opening placing boom working condition before the construction and a process of controlling the movement of first-type arms provided by an embodiment of the present invention.

Specifically, as shown in FIG. 5, a process of detecting that the pump truck is in the opening placing boom working condition before construction and controlling the first-type arms to act provided by the invention can comprise the following steps.

Step S501, judging whether the pump truck is in the pumping state according to the pumping signal, and ending the process when the pump truck is in the pumping state, otherwise, executing a step S502.

Step S502, judging whether the boom changes from the fully folded state to the non-fully folded state according to the first arm on site state signal; and if so, executing a step S503, otherwise, executing a step S504.

Step S503, triggering the timing signal for action enabling signals corresponding to the each arm in the second-type arms.

Step S504, judging whether the timing signal for the action enabling signals corresponding to the each arm in the second-type arms is triggered; and if so, executing a step S505, otherwise, ending the process.

After the boom changes from the fully folded state to the non-fully folded state, and when the timing signal for the action enabling signals corresponding to the each arm in the second-type arms is triggered, it is determined that the second-type arms start to perform the unfolding action.

Step S505, judging whether the unfolding time of the each arm in the second-type arms is smaller than the corresponding third preset time according to the timing signal; and if so, executing a step S506, otherwise, executing a step S507.

When the timing signal for the action enabling signals corresponding to the each arm in the second-type arms is triggered, start timing the unfolding process of each arm, and when the unfolding time of the each arm is smaller than the third preset time, it is indicated that the each arm in the second-type arms are not fully unfolded, that is to say, it is determined that the boom is in the opening placing boom working condition before construction. Taking second-type arms (the $4^{th}$ to $6^{th}$ arms) of a pump truck with six arms as an example, if the third preset time corresponding to the fourth, fifth and sixth arms is t4, t5 and t6 respectively (t4>t5>t6), then it is determined that the boom is in the opening placing boom working condition before construction only when the respective unfolding time of the fourth, fifth and sixth arms is smaller than t4, t5 and t6 respectively.

Step S506, controlling the each arm in the first-type arms to act at respective preset movement speed.

When the unfolding time of the each arm in the second-type arms is smaller than the corresponding third preset time, it is indicated that the each arm in the second-type arms are not fully unfolded. Only at this time, the unfolding speed of the first-type arms is controlled to be sped up.

Step S507, zeroing the accumulated unfolding time of the each arm in the second-type arms and ending the process.

If the unfolding time of one arm in the second-type arms is greater than or equal to the corresponding third preset time, it is indicated that the arm have been basically fully unfolded. At this time, the corresponding length of the boom is relatively long. If the each arm in the first-type arms is still controlled to act at a higher preset movement speed, it is very likely that the movement speed of the boom end will exceed the maximum speed set according to the safety standard, and further great safety hazard will be brought to the pump truck and the construction site. Thus, the accumulated unfolding time of the second-type arms can be zeroed, and the process is ended.

Figure 6:
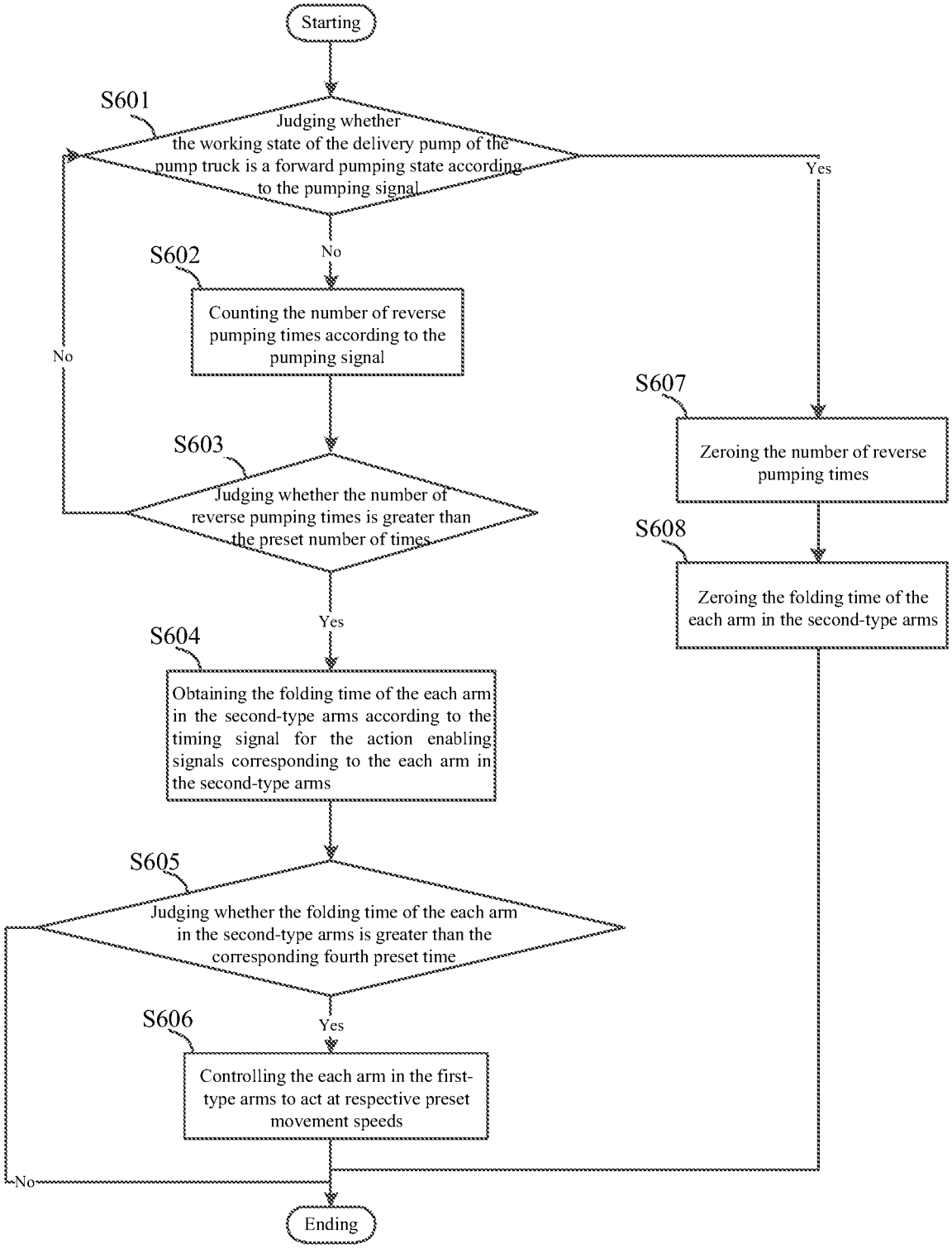
FIG. 6 is a flowchart of a process of detecting a folding placing boomworking condition after the construction and a process of controlling the movement of first-type arms provided by an embodiment of the present invention.

Specifically, as shown in FIG. 6, a process of detecting that the pump truck is in the folding placing boom working condition after construction and controlling the first-type arms to act provided by the present invention can comprise the following steps.

Step S601, judging whether the working state of the delivery pump of the pump truck is a forward pumping state according to a pumping signal; and if so, executing a step S607, otherwise, executing a step S602.

Step S602, counting the number of reverse pumping times according to the pumping signal.

Step S603, judging whether the number of reverse pumping times is greater than the preset number of times; and if so, executing a step S604, otherwise, executing the step S601.

Step S604, obtaining the folding time of the each arm in the second-type arms, according to the timing signal for the action enabling signals corresponding to the eacharm in the second-type arms.

When the timing signal for the action enabling signals corresponding to the arms in the second-type arms is triggered, start timing the folding process of the corresponding arm.

Step S605, judging whether the folding time of the each arm in the second-type arms is greater than the corresponding fourth preset time; and if so, executing a step S606, otherwise, ending the process.

When the folding time of the each arm in the second-type arms is greater than the corresponding fourth preset time, it is indicated that the folding placing boom action of each arm in the second-type arms is basically completed, that is to say, it is determined that the working condition of the boom is in the folding placing boom working condition after construction, and at this time, the arm folding speed of the first-type arms can be controlled to be sped up.

If the folding time of the each arm in the second-type arms is smaller than or equal to the corresponding fourth preset time, it is indicated that it takes some time for the folding placing boom action of each arm in the second-type arms to be completed. At this time, the length of the boom is relatively long. If the each arm in the first-type arms are still controlled to act at a higher preset movement speed, it is very likely that the movement speed of the boom end will exceed the maximum speed set according to the safety standard, and further, great safety hazard will be brought to the pump truck and the construction site. Thus, the process is ended.

Step S606, controlling the each arm in the first-type arms to act at respective preset movement speed.

Step S607, zeroing the number of reverse pumping times.

Step S608, zeroing the folding time of the each arm in the second-type arms.

Compared with the embodiment shown in FIG. 3 (or FIG. 4), the above preferred embodiment can determine whether the each arm is not fully unfolded (or basically fully folded) according to the unfolding (or folding) time of the each arm in the second-type arms, and the each arm in the first-type arms can be controlled to act at respective preset movement speed only when the each arm in the second-type arms are not fully unfolded (or basically fully folded), so that the opening placing boom (or folding placing boom) action of each arm can be more accurately controlled.

To sum up, the present invention creatively detects the working condition of the boom, and controls the each arm in the first-type arms to act at respective preset movement speed when it is detected that the boom is in the opening placing boom working condition before the construction or the folding placing boom working condition after the construction, so as to realize the speed-up control on the movement speed of the each arm in the first-type arms under the condition of the opening placing boom working condition before the construction or the folding placing boom working condition after the construction without boom posture detection sensors.

Figure 7:
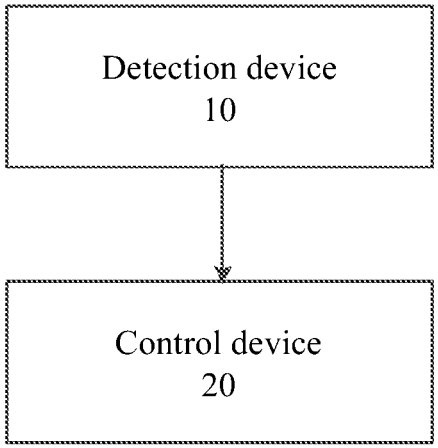
FIG. 7 is a structural diagram of a pump truck boom control system provided by an embodiment of the invention.

Accordingly, as shown in FIG. 7, the present invention also provides a pump truck boom control system, the system can comprise: a detection device 10, for detecting a working condition of a boom, wherein the boom is divided into first-type arms close to the first arm and second-type arms close to the last arm in advance; and a control device 20, for controlling each arm in the first-type arms to act at respective preset movement speed when the boom is in an opening placing boomworking condition before the construction or a folding placing boom working condition after the construction.

Wherein, the respective preset movement speed is the corresponding movement speed of the each arm when the second-type arms are fully folded and the movement speed of the ends of the first-type arms is within a movement speed threshold range.

The control device 20 can be a general-purpose processor, a dedicated processor, a conventional processor, a digital signal processor (DSP), a plurality of microprocessors, one or more microprocessors associated with a DSP core, a controller, a microcontroller, an application specific integrated circuit (ASIC), a field programmable gate array (FPGA), any other type of integrated circuit (IC), a state machine, etc.

The specific details and benefits of the pump truck boom control system can refer to the above description of the pump truck boom control method, and will not be repeated herein.

Accordingly, the present invention also provides a pump truck, and the pump truck is equipped with the above pump truck boom control system.

Accordingly, the present invention also provides a machine-readable storage medium, for storing instructions that are used for enabling a machine to execute the above pump truck boom control method.

The machine-readable storage medium comprises but is not limited to various media that can store program codes, such as a phase change memory (abbreviation for phase change random access memory, PRAM, also known as RCM/PCRAM), a static random access memory (SRAM), a dynamic random access memory (DRAM), other types of random access memory (RAM), a read-only memory (ROM), and an electrically erasable programmable read-only memory (EEPROM), a flash memory or other memory technologies, a compact disc read-only memory (CD-ROM), a digital versatile disc (DVD) or other optical storage, magnetic cassette tape, magnetic disk storage or other magnetic storage devices.

The preferred embodiments of the present invention are described in detail in combination with the accompanying drawings. However, the present invention is not limited to the specific details of the above embodiments. Within the scope of the technical concept of the present invention, various simple variants of the technical solution of the present invention can be carried out, and these simple variants belong to the protection scope of the present invention.

In addition, it should be noted that specific technical features described in the above specific embodiments can be combined in any suitable way without contradiction. In order to avoid unnecessary repetition, various possible combination modes of the present invention will not be explained separately.

In addition, various different embodiments of the present invention can be optionally combined, so long as the embodiments do not violate the concept of the present invention, and should also be regarded as the content disclosed by the present invention.

The invention claimed is:

1. A pump truck boom control method, comprising:

detecting a working condition of a boom, wherein the boom includes a plurality of arms which includes at least a first arm and a last arm, the plurality of arms is divided into first-type arms close to the first arm and second-type arms close to the last arm in advance of detecting the working condition of the boom; and controlling each arm in the first-type arms to act at respective preset movement speed when the boom is in an opening placing boom working condition after the pump truck reaches a new construction position or in a folding placing boom working condition before the pump truck transfers, wherein the step of detecting a working condition of a boom comprises:

collecting a pumping state signal, the first arm on site state signal and a timing signal for action enabling signals corresponding to the each arm in the second-type arms; and determining the working condition of the boom, according to the pumping state signal, the first arm on site state signal and the timing signal for the action enabling signals corresponding to the each arm in the second-type arms.

2. The pump truck boom control method according to claim 1, wherein the respective preset movement speed is corresponding movement speed of each arm under the condition that a boom end speed when the second-type arms are fully folded and the first-type arms are fully unfolded is within a movement speed threshold range.

3. The pump truck boom control method according to claim 1, wherein the step of determining the working condition of the boom, according to the pumping state signal, the first arm on site state signal and the timing signal for the action enabling signals corresponding to the each arm in the second-type arms comprises:

determining that the boom is in the opening placing boom working condition after the pump truck reaches a new construction position, when the pumping state signal indicates that the pump truck is not in a pumping state, the first arm on site signal indicates that the boom changes from a fully folded state to a non-fully folded state, and accumulated unfolding time, determined by the timing signal, of the second-type arms is smaller than first preset time; or determining that the boom is in the folding placing boom working condition before the pump truck transfers, when the pumping state signal indicates that the pump truck is in a reverse pumping state, and the number of reverse pumping times is greater than a preset number of times, and accumulated folding time, determined by the timing signal, of the second-type arms is greater than second preset time, wherein, the first preset time is a product of the time taken by the second-type arms to be fully unfolded and a first preset coefficient, the second preset time is a product of the time taken by the second-type arms to be fully folded and a second preset coefficient, and both the first preset coefficient and the second preset coefficient are smaller than 1.

4. The pump truck boom control method according to claim 1, wherein the step of determining the working condition of the boom, according to the pumping state signal, the first arm on site state signal and the timing signal for the action enabling signals corresponding to the each arm in the second-type arms comprises:

determining that the boom is in the opening placing boom working condition after the pump truck reaches a new construction position, when the pumping state signal indicates that the pump truck is not in the pumping state, the first arm on site signal indicates that the boom changes from the fully folded state to the non-fully folded state, and unfolding time, determined by the timing signal, of any one arm in the second-type arms is smaller than corresponding third preset time; or determining that the boom is in the folding placing boom working condition before the pump truck transfers, when the pumping state signal indicates that the pump truck is in the reverse pumping state, and the number of reverse pumping times is greater than the preset number of times, and folding time, determined by the timing signal, of any one arm in the second-type arms is greater than corresponding fourth preset time, wherein, the corresponding third preset time is a product of the time taken by each arm in the second-type arms to be fully unfolded and a third preset coefficient, the corresponding fourth preset time is a product of the time taken by each arm in the second-type arms to be fully folded and a fourth preset coefficient, and both the third preset coefficient and the fourth preset coefficient are smaller than 1.

5. A pump truck boom control system, comprising:

a detection device, for detecting a working condition of a boom, wherein the boom includes a plurality of arms which includes at least a first arm and a last arm, the plurality of arms is divided into first-type arms close to the first arm and second-type arms close to the last arm in advance of detecting the working condition of the boom; and a control device, for controlling each arm in the first-type arms to act at respective preset movement speed when the boom is in an opening placing boom working condition after the pump truck reaches a new construction position or in an opening placing boom working condition before the pump truck transfers, wherein the detection device comprises:

a collecting unit, for collecting a pumping state signal, the first arm on site state signal and a timing signal for action enabling signals corresponding to the each arm in the second-type arms; and a determining unit, for determining the working condition of the boom, according to the pumping state signal, the first arm on site state signal and the timing signal for the action enabling signals corresponding to the each arm in the second-type arms.

6. The pump truck boom control system according to claim 5, wherein the respective preset movement speed is corresponding movement speed of each arm under the condition that a boom end speed when the second-type arms are fully folded and the first-type arms are fully unfolded is within a movement speed threshold range.

7. The pump truck boom control system according to claim 5, wherein a process of determining, by the determining unit, the working condition of the boom, according to the pumping state signal, the first arm on site state signal and the timing signal for the action enabling signals corresponding to the each arm in the second-type arms comprises:

determining that the boom is in the opening placing boom working condition after the pump truck reaches a new construction position, when the pumping state signal indicates that the pump truck is not in a pumping state, the first arm on site signal indicates that the boom changes from a fully folded state to a non-fully folded state, and accumulated unfolding time, determined by the timing signal, of the second-type arms is smaller than first preset time; or determining that the boom is in the folding placing boom working condition before the pump truck transfers, when the pumping state signal indicates that the pump truck is in a reverse pumping state, the number of reverse pumping times is greater than a preset number of times, and accumulated folding time, determined by the timing signal, of the second-type arms is greater than second preset time, wherein, the first preset time is a product of the time taken by the second-type arms to be fully unfolded and a first preset coefficient, the second preset time is a product of the time taken by the second-type arms to be fully folded and a second preset coefficient, and both the first preset coefficient and the second preset coefficient are smaller than 1.

8. The pump truck boom control system according to claim 5, wherein a process of determining, by the determining unit, the working condition of the boom, according to the pumping state signal, the first arm on site state signal and the timing signal for the action enabling signals corresponding to the each arm in the second-type arms comprises determining that the boom is in the opening placing boom working condition after the pump truck reaches a new construction position, when the pumping state signal indicates that the pump truck is not in the pumping state, the first arm on site signal indicates that the boom changes from the fully folded state to the non-fully folded state, and unfolding time, determined by the timing signal, of any one arm in the second-type arms is smaller than corresponding third preset time; or determining that the boom is in the folding placing boom working condition before the pump truck transfers, when the pumping state signal indicates that the pump truck is in the reverse pumping state, and the number of reverse pumping times is greater than the preset number of times, and folding time, determined by the timing signal, of any one arm in the second-type arms is greater than corresponding fourth preset time, wherein, the corresponding third preset time is a product of the time taken by each arm in the second-type arms to be fully unfolded and a third preset coefficient, the corresponding fourth preset time is a product of the time taken by each arm in the second-type arms to be full folded and a fourth preset coefficient, and both the third preset coefficient and the fourth preset coefficient are smaller than 1.

9. A pump truck, being equipped with the pump truck boom control system according to claim 5.

* * * * *